US011851832B2

(12) United States Patent
Reed et al.

(10) Patent No.: US 11,851,832 B2
(45) Date of Patent: Dec. 26, 2023

(54) MACHINE SERVICE SET POSITION CONTROL SYSTEM

(71) Applicant: CATERPILLAR PAVING PRODUCTS INC., Brooklyn Park, MN (US)

(72) Inventors: Garrett Daniel Reed, Big Lake, MN (US); Brian Joe Schlenker, Shoreview, MN (US); Paul J Koenen, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 17/555,781

(22) Filed: Dec. 20, 2021

(65) Prior Publication Data

US 2023/0193572 A1 Jun. 22, 2023

(51) Int. Cl.
*E01C 23/088* (2006.01)
*E01C 23/12* (2006.01)
*E01C 21/00* (2006.01)

(52) U.S. Cl.
CPC ..... *E01C 23/088* (2013.01); *E01C 21/00* (2013.01); *E01C 23/127* (2013.01)

(58) Field of Classification Search
CPC ..... E01C 21/00; E01C 23/088; E01C 23/127; E01C 23/065; E02F 9/0833; F16H 57/0408; A01D 2034/645
See application file for complete search history.

(56) References Cited

U.S. PATENT DOCUMENTS

| | | | | |
|---|---|---|---|---|
| 4,929,121 | A * | 5/1990 | Lent | E01C 23/088 404/90 |
| 8,864,621 | B2 | 10/2014 | Phebus et al. | |
| 8,941,504 | B2 | 1/2015 | Sheets | |
| 9,593,974 | B2 | 3/2017 | Funk et al. | |
| 10,096,174 | B2 | 10/2018 | Watson et al. | |
| 2009/0108663 | A1* | 4/2009 | Berning | E01C 23/088 299/1.5 |
| 2013/0166155 | A1* | 6/2013 | Killion | E01C 23/088 701/50 |

(Continued)

FOREIGN PATENT DOCUMENTS

JP 2011007065 A 1/2011

*Primary Examiner* — Janine M Kreck
*Assistant Examiner* — Michael A Goodwin
(74) *Attorney, Agent, or Firm* — Finnegan, Henderson, Farabow, Garett & Dunner, L.L.P.

(57) ABSTRACT

A machine service set position control system is used on a machine that includes a frame, traction devices connected to the frame, a power source connected to the traction devices and configured to rotate the traction devices, a drum chamber connected to the frame, a milling drum rotatably supported within the drum chamber and configured to engage with a ground surface, and a rotor drive train connected to the milling drum and configured to rotate the milling drum to mill the ground surface, the rotor drive train including a gearbox. The service set position control system is programmed to determine a position of at least the rotor drive train and selectively operate a rotor drive train actuator connected to the rotor drive train based on the determined position to move the machine into a machine service set position allowing easy access for a technician to perform service.

15 Claims, 5 Drawing Sheets

(56) References Cited

U.S. PATENT DOCUMENTS

| | | | | |
|---|---|---|---|---|
| 2018/0023260 | A1* | 1/2018 | Muir | E01C 21/00 404/84.05 |
| 2018/0135257 | A1* | 5/2018 | Schlenker | E02F 3/20 |
| 2018/0170462 | A1* | 6/2018 | Barimani | B60G 17/005 |
| 2019/0126710 | A1* | 5/2019 | Hedlund | B60G 3/01 |
| 2021/0229516 | A1* | 7/2021 | Engelmann | B60G 17/019 |

* cited by examiner

MACHINE SERVICE SET POSITION CONTROL SYSTEM

TECHNICAL FIELD

The present disclosure relates generally to a machine control system and, more particularly, to a machine service set position control system.

BACKGROUND

It is sometimes desirable to stabilize or reconstitute an upper layer of a worksite (e.g. parcel of land, parking lot, building site, etc.), or remove paving material, before constructing a roadway or other structure on the worksite. This is usually accomplished by removing the upper layer of material from the worksite, mixing it with stabilizing components such as cement, ash, lime, etc., and depositing the mixture back on the worksite. A machine, such as a reclaimer, stabilizer, or rotary mixer is often used for this purpose. Removal of paving material from a roadway for depositing in a haul vehicle and removal from a job site may also be accomplished using a cold planer. Such reclaimers or cold planers may include a frame supported by wheels or tracks and a milling drum attached to the frame. The milling drum is enclosed in a drum chamber. The cutting tools or teeth on the milling drum tear up the ground and remove material. The rotating milling drum may also help to mix the removed material with stabilizing ingredients and/or water. The reconstituted material then exits the drum chamber and is deposited back on to the ground surface, usually towards a rear of the drum chamber.

The drum chamber includes movable doors at the front and rear of the drum chamber. An operator of the reclaimer typically adjusts the amount of opening of the front and rear doors manually. The positions of the front and rear doors relative to the ground surface can be used to control the amount of mixing in the drum chamber and the gradation (e.g. graininess or particle size distribution) of the resulting mixture that is deposited on the ground surface.

Regardless of whether a machine such as a reclaimer or rotary mixer is used to remove material from a road surface and mix the material with stabilizing ingredients before depositing the mixture back on the work site, or a machine such as a cold planer is used to remove material from a road surface so that the material can be hauled away from the work site, such machines require regular maintenance and repair as components such as a milling drum are operated under extremely stressful conditions. Maintenance may require frequently checking the oil level in the gearbox of a rotor drive train of the machine, and adding or replacing oil as required. However, such machines often must be manipulated through a series of operational commands into one or more particular service set positions in order to allow a technician to access and observe oil level check ports or perform other maintenance or repair procedures. The process of moving the machine and the various components of the machine into the service set positions for maintenance and/or repair can be very time consuming and difficult for an operator since the controls that are required for moving the machine and components of the machine are located in the operator cab or on the operator platform at a location from which it is difficult to determine whether a desired service set position has been achieved. Moreover, a large number of different operations may have to be performed in sequence in order to move the machine to a level ground surface, move particular components of the machine into the best position possible for enabling access to areas that must be observed or accessed for maintenance or repair, and locking the machine into the service set position for safety reasons while a technician is working on the machine. The machine control system of the present disclosure solves one or more of the problems set forth above and/or other problems of the prior art.

SUMMARY

In one aspect, the present disclosure is directed to a machine service set position control system, for use on a machine that includes a frame, a plurality of traction devices connected to the frame, a power source connected to the plurality of traction devices and configured to rotate the traction devices, a drum chamber connected to the frame, a milling drum positioned within the drum chamber and configured to engage with a ground surface, and a rotor drive train connected to the milling drum and configured to rotate the milling drum to mill the ground surface. The rotor drive train may include a gearbox. The machine service set position control system may be programmed to determine a position of the machine and a position of at least the rotor drive train with the gearbox, and then issue commands to level the machine and selectively operate a rotor drive train actuator connected to the rotor drive train based on the determined positions to move the rotor drive train and rotor drive train gearbox into a service position allowing easy access for a technician to perform service tasks including one or more of inspecting an oil level in the rotor drive train gearbox and adding oil if required.

In another aspect, the present disclosure is direct to a machine having a frame supported by a plurality of wheels, a power source connected to the plurality of wheels and configured to rotate the wheels, a milling drum attached to the frame through a rotor drive train including a gearbox, the rotor drive train being configured to rotate the milling drum and move the milling drum into and out of engagement with a ground surface. The machine may include a machine service set position control system programmed to determine a position of the machine and a position of at least the rotor drive train and milling drum, and then issue commands to level the machine and selectively operate a rotor drive train actuator connected to the rotor drive train based on the determined positions to move the rotor drive train and gearbox into a service position allowing easy access for a technician to perform service tasks including one or more of inspecting an oil level in the rotor drive train gearbox and adding oil if required.

In yet another aspect, the present disclosure is directed to a method of performing maintenance on a machine. The machine may include a frame supported by a plurality of wheels, a power source connected to the plurality of wheels and configured to rotate the wheels, and a milling drum attached to the frame through a rotor drive train including a gearbox, the rotor drive train being configured to rotate the milling drum and move the milling drum into and out of engagement with a ground surface. The method may include determining a position of the machine and a position of at least the rotor drive train with the gearbox, issuing commands to level the machine and selectively operate a rotor drive train actuator connected to the rotor drive train based on the determined positions to move the rotor drive train and gearbox into a service position allowing easy access for a technician to perform service tasks including one or more of inspecting an oil level in the rotor drive train gearbox and adding oil if required.

DETAILED DESCRIPTION

Figure 1:
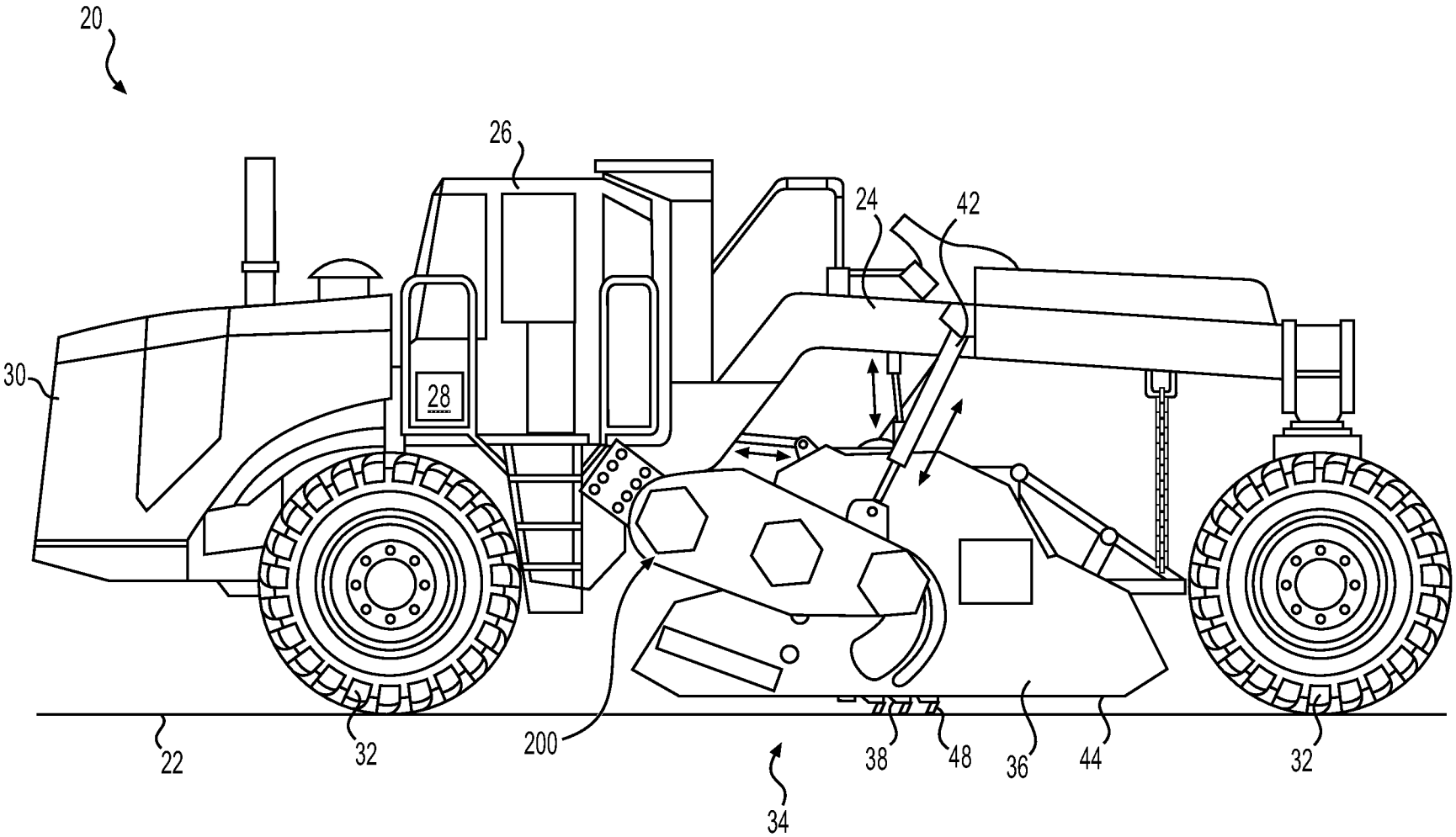
FIG. 1 is an illustration of an exemplary reclaimer.
Figure 2:
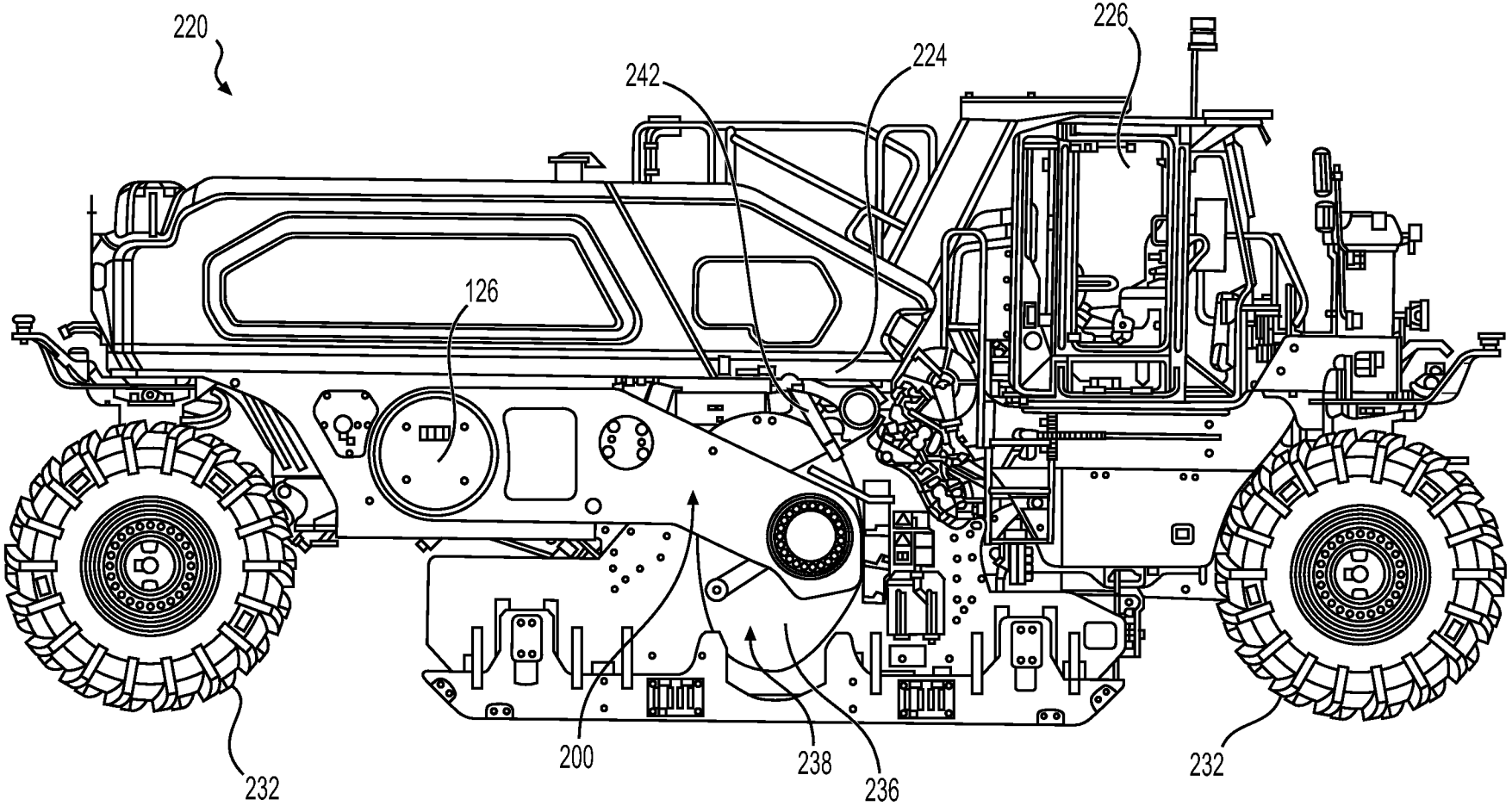
FIG. 2 is an illustration of an exemplary rotary mixer.

FIGS. 1 and 2 illustrate exemplary machines 20, 220. In one exemplary embodiment as illustrated in FIG. 1, machine 20 may be a reclaimer, which may also be called rotary mixer, soil stabilizer, reclaiming machine, road reclaimer, etc. Another exemplary embodiment of a rotary mixer 220 is shown in FIG. 2. Machines 20, 220 may include a frame 24, 224, which may extend from underneath a cab 26, 226 at a front end of machine 20, 220 to a rear end of machine 20, 220. Frame 24, 224 may be supported on one or more traction devices 32, 232. Traction devices 32, 232 may be equipped with electric or hydraulic motors that may impart motion to the traction devices to help propel the machine in a forward or rearward direction, or alternatively, a power source such as an engine or one or more batteries may provide propulsion power to the traction devices. In some exemplary embodiments, such as illustrated in FIGS. 1 and 2, traction devices 32, 232 may take the form of wheels. It is contemplated, however, that the traction devices may take the form of tracks, which may include, for example, sprocket wheels, idler wheels, and/or one or more rollers that may support a continuous track. The general principles of the present disclosure may also be applied with machines other than a reclaimer or rotary mixer, such as cold planers, and other machines that may require service or maintenance involving moving certain portions or components of the machine into positions that enable or facilitate actions by a technician to observe and perform the required service, maintenance, or repair, referred to herein as a "machine service set position".

A pair of rear wheels 32 may be located adjacent a rear end of frame 24, and a pair of front wheels 32 may be located adjacent cab 26 and a hood 30 supported at a front end of frame 24, with the pairs of wheels being spaced apart from each other in a length direction of frame 24, and with each of the wheels in each pair of wheels being spaced apart from each other in a width direction of machine 20. The pair of front wheels 32 may be located adjacent a combustion engine or other source of propulsion power, such as batteries, or a fuel cell, disposed under hood 30 in front of cab 26. In alternative embodiments, such as rotary mixer 220 shown in FIG. 2, an engine may be located adjacent a rear pair of wheels 232 at a rear end of rotary mixer 220. Some or all of the wheels 32, 232 may also be steerable, allowing machine 20, 220 to be turned towards the right or left during a forward or rearward motion on a ground surface 22. Although machines 20, 220 in FIGS. 1 and 2 have been illustrated as including four wheels 32, 232 it is contemplated that in some exemplary embodiments, machine 20, 220 may have only one rear wheel, which may be located generally centered along a width of frame 24, 224.

Frame 24, 224 may be connected to wheels 32, 232 by one or more legs in some exemplary embodiments. One or more of the legs may be height adjustable such that a height of frame 24 relative to one or more of wheels 32 may be increased or decreased by adjusting a length of one or more of the legs, respectively. For example, the legs may be equipped with leg actuators which when extended or retracted may adjust the lengths of the legs. Leg actuators may be disposed outside or within the legs. These leg actuators may include, for example, single-acting or double-acting hydraulic or pneumatic piston-cylinder type actuators.

Adjusting a height of frame 24, 224 relative to one or more of wheels 32, 232 would also adjust a height of frame 24, 224 relative to ground surface 22 on which wheels 32, 232 may be supported. Machine 20, 220 may be equipped with one or more height sensors 34, 40. For example, one or more height sensors 34, 40 may be positioned anywhere on frame 24, 224 or other portions of machine 20, 220. Height sensors may be positioned on either or both of left and right sides of frame 24, 224. Machine 20, 220 may include any number of height sensors. Height sensor 34, 40 may be, for example, placed along a bottom surface of a drum chamber 36 pivotably supported along a bottom central portion of frame 24, or at other portions of machine 20. One or more actuators such as hydraulic cylinder 42 shown in FIG. 1, or hydraulic cylinder may be actuated to control the height and orientation of drum chamber 36, the angle of rotor drive train 200 relative to frame 24 and road surface 22, and the position of a milling drum 38 relative to road surface 22. In an alternative embodiment, such as the rotary mixer 220 of FIG. 2, drum chamber 236 may be rigidly attached to the machine frame and only milling drum 238 may be raised and lowered through the use of one or more actuators.

Figure 3:
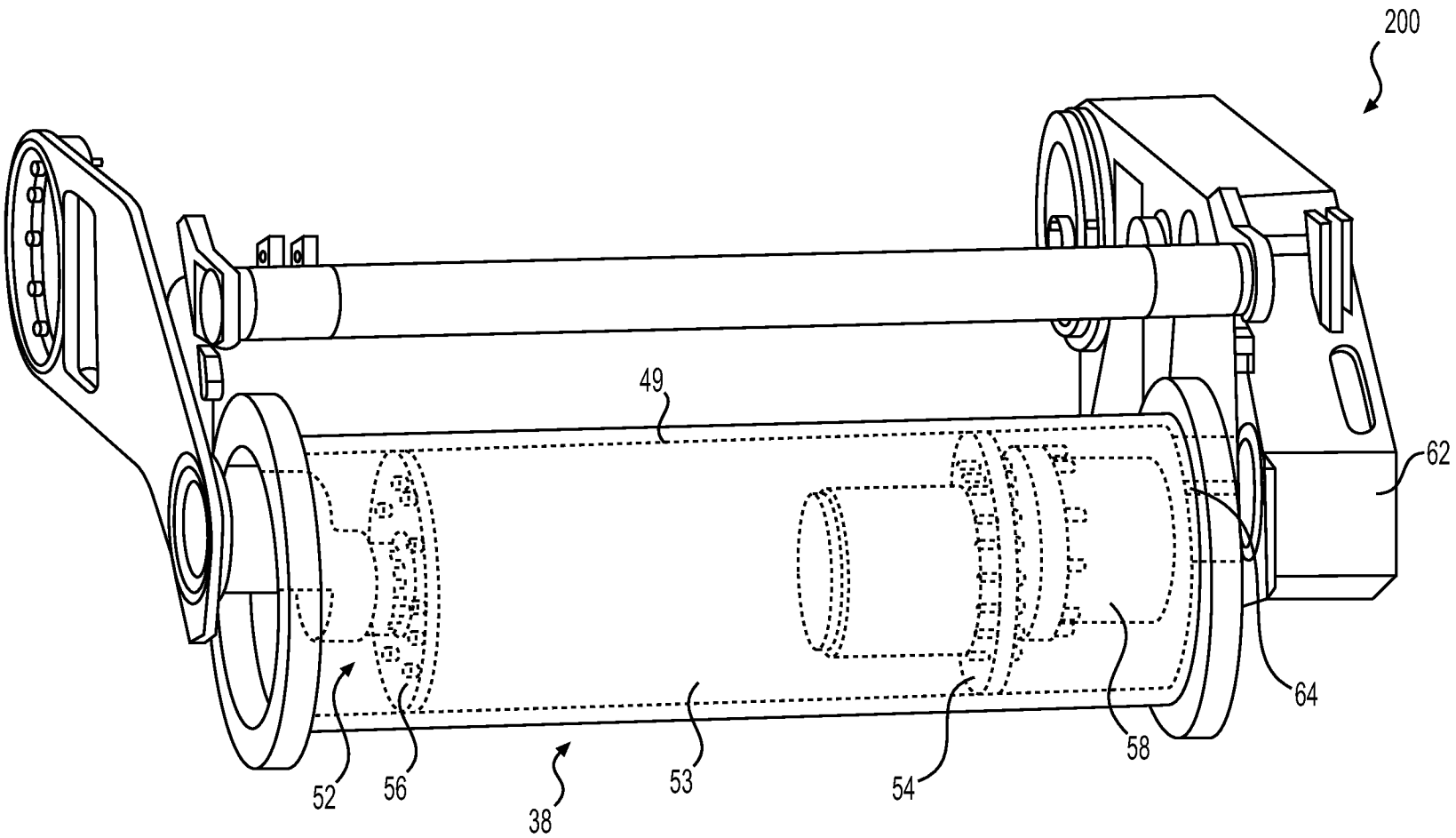
FIG. 3 is a view of a rotor drive train of the exemplary rotary mixer of FIG. 2.

FIG. 3 illustrates a view of rotor drive train 200 that may be pivotably supported from frame 224 for rotatably supporting milling drum 238 of a rotary mixer 220 shown in FIG. 2. Milling drum 238 may be lowered and brought into contact with a road surface 22, and retracted upwardly and away from the road surface as viewed from a front end of machine 220. In some embodiments, machine 20 may include one or more height adjustable legs that may be attached to frame 24. The height adjustable legs attached to frame 24 may be configured for adjusting the height of frame 24 relative to a ground surface. Additional fixed or structural beams referred to as extenders may be provided that extend up to or beyond a width of frame 24. One or more height sensors and/or angle sensors may be attached to the height adjustable legs. A height sensor may be disposed on a right side of machine 20 in an outboard position. In some embodiments an extender may extend outward beyond a width of frame 24 to position the height sensor outside of a footprint of frame 24. A height sensor may also be disposed on a left side of machine 20 in an inboard position. That is, an extender may not extend beyond a width of frame 24 and may position the height sensor within a footprint of frame 24. It is contemplated that each of the height sensors may be positioned at an inboard or outboard position. Extenders may additionally or alternatively be attached to frame 24 adjacent a front end of frame 24, or at any other location between the front end and the rear end of frame 24.

A height sensor may be configured to determine a height of frame 24 relative to ground surface 22. In one exemplary embodiment, a height sensor may be an ultrasonic sensor configured to determine the height based on reflected ultrasonic sound waves. It is contemplated, however, that other types of height sensors may be used on machine 20. For example, a height sensor may include one or more laser sensors, one or more single-beam LIDAR sensors, multi-beam LIDAR sensors, multi-layer LIDAR sensors, RADAR sensors, inertial sensors, etc. It is contemplated that machine 20 may include a same type of sensor (e.g. LIDAR, RADAR, ultrasonic, laser, etc.) or may include sensors of different types at different locations on frame 24. In some exemplary embodiments, a height sensor may be capable of detecting the height of frame 24 relative to ground surface 22 based on a reflection of electromagnetic radiation from ground surface 22. For example, a height sensor may include a transmitter configured to transmit electromagnetic radiation toward ground surface 22 and a receiver configured to receive the reflected electromagnetic radiation from ground surface 22. The electromagnetic radiation may include, for example, visible light, infrared light, ultraviolet light, laser light, radio waves or microwaves. In other exemplary embodiments, a height sensor may include one or more imaging devices. For example, a height sensor may include one or more mono or stereo cameras configured to obtain 2D or 3D images of ground surface 22 and/or one or more traction devices 32. Such a height sensor may also include a processor configured to execute one or more image processing algorithms (e.g. photogrammetry, segmentation, edge detection, projection, convolution, extrapolation) to determine a height of frame 24 relative to ground surface 22. It is also contemplated that in some exemplary embodiments, a height sensor may be a contact type sensor having a sensor element touch ground surface 22 and/or a stringline disposed at a predetermined height above ground surface 22. Movement of the sensor element may be used to determine changes in a height of frame 24 relative to ground surface 22. It is further contemplated that in some exemplary embodiments, a height sensor may include a Global Positioning System (GPS) sensor configured to determine a height of frame 24 relative to ground surface 22 based on signals communicated between the height sensor and one or more GPS satellites. It is also contemplated that in some exemplary embodiments, one or more of the leg actuators associated with extenders for adjusting the height of frame 24 may include one or more position sensing devices configured to determine an amount of extension of the leg actuators. In these exemplary embodiments, a controller 150 of machine 20 may be configured to determine a height of frame 24 relative to ground surface 22, using signals received from the one or more position sensing devices.

Returning to FIG. 1, milling drum 38 of machine 20 may be located between the front and rear ends of machine 20. The term milling drum may encompass terms such as drum, cutting drum, working drum, mixing drum, etc. In one exemplary embodiment as illustrated in FIG. 1, milling drum 38 of machine 20 may not be directly attached to frame 24. Instead, as illustrated in FIG. 1, milling drum 38 of machine 20 may be connected to frame 24 via rotor drive trains 200 on left and right sides of machine 20, or by one rotor drive train 200 on one side of machine 20 connected by one or more cross bars to a pivotable arm located parallel to the one rotor drive train 200 on the opposite side of machine 20. Rotor drive trains 200 may include a pair of arms (only one of which is visible in FIG. 1) disposed on either side of machine 20 along a width direction of frame 24. In some embodiments there may be only one rotor drive train 200 on one side of machine 20, connected with a pivotable arm disposed on the opposite side of machine 20, as shown, for example, in FIG. 3. Rotor drive trains 200 may be pivotably mounted along an extent of frame 24 and extend from frame 24 towards either the front end or the rear end of frame 24. Milling drum 38 may be attached to the distal end of one or more rotor drive trains 200. As shown in FIG. 3, milling drum 38 may include a cylindrical housing 49, 53 extending between rotor drive train 200 on one side of machine 20 and a pivotably mounted arm extending parallel to rotor drive train 200 on the opposite side of machine 20. In one exemplary embodiment, power may be transferred to drive train 200 from a power source housed under hood 30 at a front end of machine 20. In alternative embodiments, power may be transferred from a power source located at a rear of the machine. A power input device may include a gear or gears that transfer power into rotor drive train 200 at one end, with a gearbox 58 disposed at an output end 62 of rotor drive train 200. Gearbox 58 may be supported within cylindrical housing 49, 53 by a flange 54 at one side of machine 20, while the opposite side 52 of cylindrical housing 49, 53 may be supported on a flange 56. Power may be transferred through gearbox 58 to milling drum 38. Gearbox 58 may be configured to provide the required gear ratio or gear ratios for transfer of power from rotor drive train 200 to milling drum 38. Milling drum 38 of machine 20 may include cutting tools 48 (or teeth 48).

A height of milling drum 38 above the ground surface may be adjusted by pivoting rotor drive trains 200 relative to frame 24 and/or by adjusting a height of one or more of extenders provided to adjust the height of frame 24 relative to ground surface 22. As milling drum 38 rotates, teeth 48 may come into contact with and mill, grind, tear, cut, or pulverise the ground surface 22 or roadway surface. Milling drum 38 may be enclosed within drum chamber 36 which may help contain the material removed by teeth 48 from the ground or roadway surface. Milling drum 38 may be movable within drum chamber 36 such that a height between an upper surface of milling drum 38 and an inner surface of drum chamber 36 may be variable. In some exemplary embodiments, drum chamber 36 may be fixedly attached to frame 24. It is contemplated, however, that in other exemplary embodiments, drum chamber 36 may be movable relative to frame 24. It is also contemplated that in some exemplary embodiments, one or more height sensors 40 may additionally or alternatively be positioned anywhere on drum chamber 36, including anywhere along a bottom surface 44 of drum chamber 36, as shown in FIG. 1, and may be configured to determine a height of drum chamber 36 relative to ground surface 22. A gearbox oil level check port 64 may be provided through the end plate of cylindrical housing 49, 53 of milling drum 38 to allow a technician to observe the oil level in the gearbox.

Machine 20 may also include an internal combustion engine, hybrid combination of an internal combustion engine and one or more electric motors, a fully electric power source from one or more batteries, one or more fuel cells, and other potential sources of power. The power source for machine 20 may be configured to deliver rotational power output to one or more hydraulic motors associated with traction devices 32, and through one or more rotor drive trains 200 to milling drum 38. The power source may also be configured to deliver power to operate one or more other components or accessory devices (e.g. pumps, fans, motors, generators, belt drives, transmission devices, etc.) associated with machine 20. Further, the power source may be configured to deliver power to one or more actuators, for example, actuators responsible for moving rotor drive trains 200 and/or movable front and rear doors of drum chamber 36.

Operator cab 26 or other operator platform 28 may be attached to frame 24. In some exemplary embodiments, an operator platform 28 may be in the form of an open-air platform that may or may not include a canopy. In other exemplary embodiments, operator cab 26 may be in the form of a partially or fully enclosed cabin. The operator cab or platform may include one or more control or input devices (e.g. joysticks, levers, buttons, dials, switches, pedals, icons on touch screens, etc.) that may be used by an operator of machine 20 to control operations of machine 20. The operator cab or platform may be configured to be positioned at different positions along the width and length of frame 24.

Figure 4:
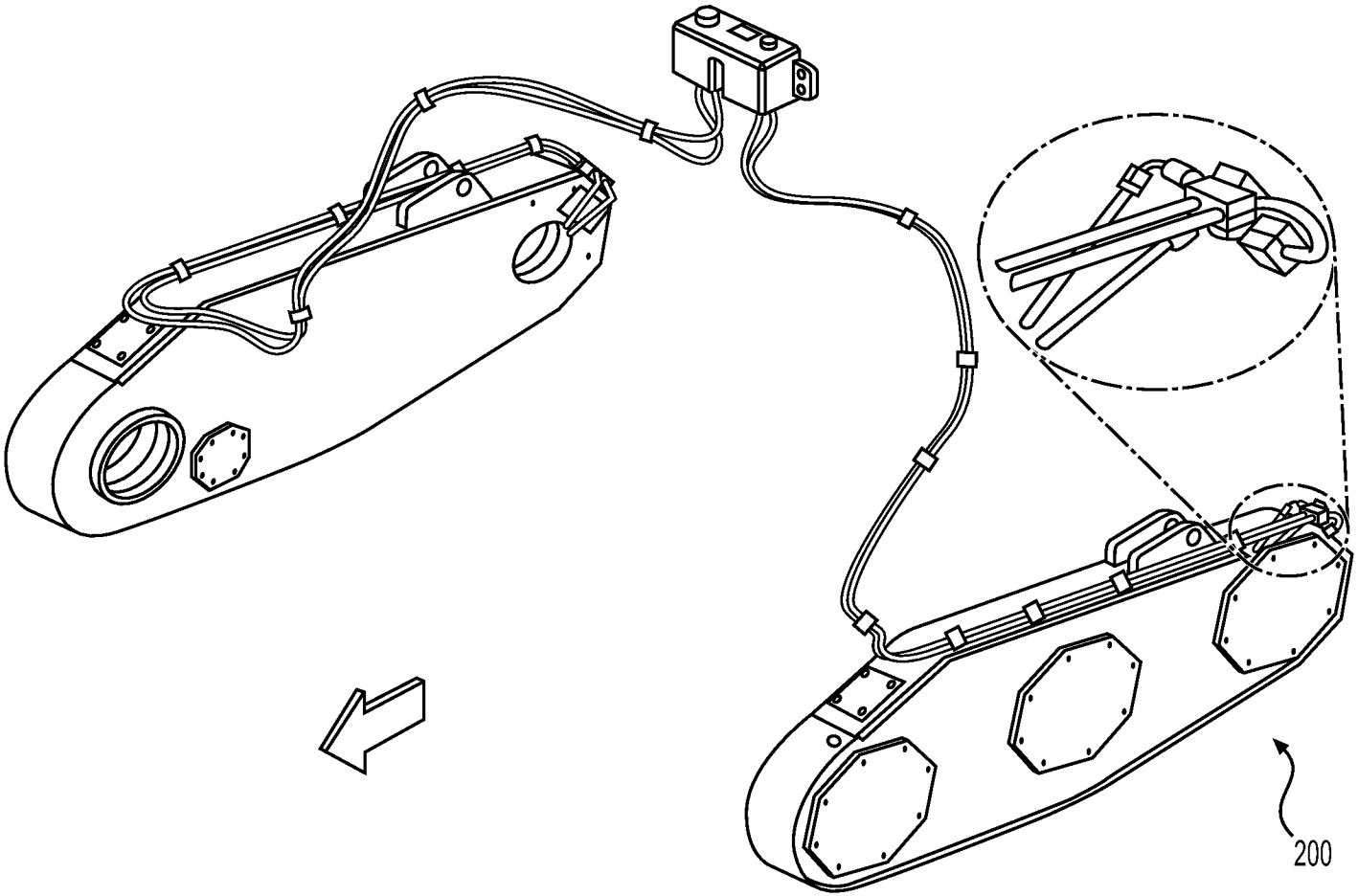
FIG. 4 is an illustration of oil lines and an oil reservoir for a rotor drive train of an exemplary rotary mixer.

FIG. 4 illustrates oil lines extending from along one or more of rotor drive trains 200 disposed along one or both of opposite sides of machine 20, 220 to an oil reservoir disposed in between the opposite sides of machine 20, 220. Rotor drive trains 200 may be disposed on one or both of left and right sides of frame 24, 224. Rotor drive trains 200 may be pivotably attached to frame 24, 224 and may be configured to be rotatable relative to frame 24, 224 through actuation of one or more actuators 42. Rotor drive trains 200 may have a common pivot axis disposed transverse to frame 24 and generally parallel to a width direction of frame 24. Actuators 42 may be single-acting or double-acting hydraulic actuators, single-acting or double-acting pneumatic actuators, or may include a rack and pinion arrangement, a belt and pulley arrangement, etc.

In some exemplary embodiments, traction devices 32 may be connected to frame 24, and frame 24 of machine 20 may not be configured to be raised or lowered relative to traction devices 32 and/or ground surface 22. One pair of traction devices 32 may be separated from each other along a width direction of machine 20 and may be positioned adjacent one end of machine 20. Similarly, another pair of traction devices 32 may be separated from each other along a width direction of machine 20 and may be positioned adjacent the opposite end of machine 20. Although traction devices 32 have been illustrated as wheels in FIGS. 1 and 2, it is contemplated that traction devices 32 may instead include tracks, and one or more of traction devices 32 may be steerable, allowing machine 20 to be turned towards the right or left during a forward or rearward motion on ground surface 22.

Machine 20 may include milling drum 38 located between the front and rear ends of machine 20. In one exemplary embodiment as illustrated in FIG. 3, milling drum 38 of machine 20 may not be directly attached to frame 24. Instead, milling drum 38 of machine 20 may be attached to frame 24 via rotor drive trains 200. Rotor drive trains 200 may include a pair of arms disposed on either side of machine 20. Rotor drive trains 200 may be pivotably attached to frame 24 and may be configured to be rotatable relative to frame 24. One or more actuators 42 may be connected between frame 24 and rotor drive trains 200 and may be configured to move rotor drive trains 200 relative to frame 24.

Milling drum 38 of machine 20 may include cutting tools 48 (or teeth 48). A height of milling drum 38 above the ground surface may be adjusted by rotating rotor drive trains 200 relative to frame 24. As milling drum 38 rotates, teeth 48 may come into contact with and tear or cut the ground or roadway surface. Milling drum 38 may be enclosed within drum chamber 36 which may help contain the material removed by teeth 48 from ground surface 22. Drum chamber 36 may be connected to frame 24 and may be movable relative to frame 24. Further, milling drum 38 may be movable within drum chamber 36 such that a height between an upper surface of milling drum 38 and an inner surface of drum chamber 36 may be variable.

Position sensors 120 for determining the height and other location information on various portions or components of machine 20 may include non-contact LIDAR, RADAR, laser, or other types of sensors configured to generate signals representing an amount of extension or retraction of an actuator, amount of rotation of a pivotal structure, proximity to a surface, geographical position in space, etc. In some exemplary embodiments, position sensor 120 may include a rotary encoder or other type of rotational sensor configured to determine an angle of rotation of rotor drive train 200 relative to frame 24. In yet other exemplary embodiments, position sensor 120 may be a contact or non-contact sensor, similar to height sensors attached to frame 24 of machine 20, and may be configured to generate a signal indicative of a distance between frame 24 and another component of machine 20 such as rotor drive train 200. In other exemplary embodiments, position sensor 120 may include one or more imaging devices configured to obtain an image of a portion of machine 20. The imaging devices may include one or more processors configured to execute one or more image processing algorithms (e.g. photogrammetry, segmentation, edge detection, projection, convolution, extrapolation) to generate a signal indicative of a position of a portion or component of machine 20 relative to a location of position sensor 120. As will be discussed below, a controller 152 associated with machine 20 in accordance with various embodiments of this disclosure may be configured (programmed) to determine a position of a portion or component of machine 20 based on the signals received from any of the above-described position sensors 120.

Figure 5:
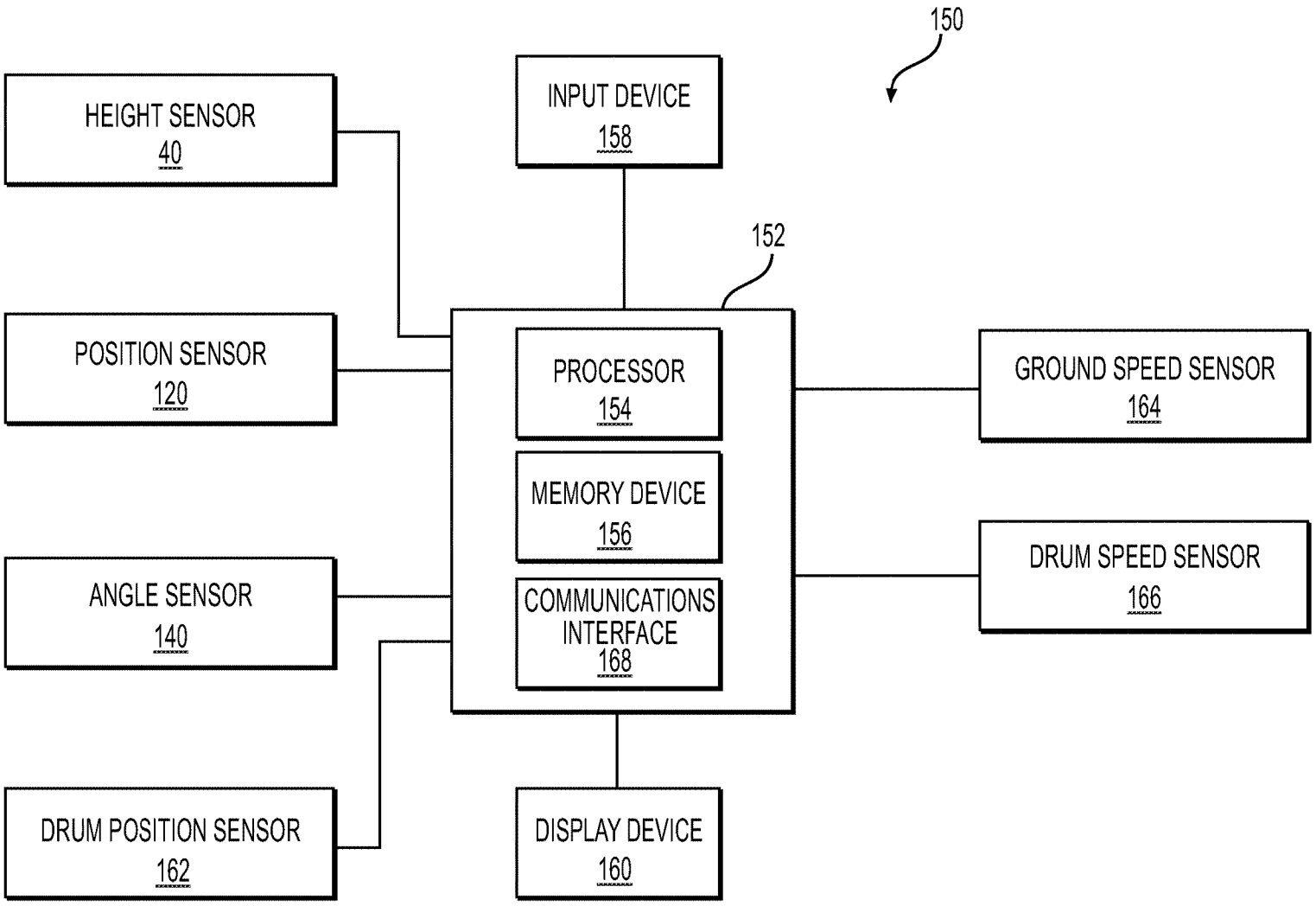
FIG. 5 is a schematic diagram of an exemplary machine service set position control system.

FIG. 5 shows an exemplary control system 150 according to an embodiment of this disclosure for controlling the positions of various portions and components of machine 20 in order to properly position the portions and components of machine 20 relative to each other and relative to ground surface 22 such that a technician can readily access areas and parts needed for maintenance or repair tasks such as checking oil levels and adding oil, or performing other maintenance or repair procedures. For example, control system 150 may be configured (programmed) to automatically level machine 20 using one or more of extenders provided to adjust the height of frame 24 relative to ground surface 22, or in some exemplary implementations, control system 150 may be programmed to move machine 20 to a position where machine 20 is level, positioned on a level area of ground surface 22. Control system 150 may also be programmed to raise or lower the level of drum chamber 36, rotor drive train 200, and milling drum 38, relative to ground surface 22 and relative to each other, into a predetermined position at which the technician can easily observe a gearbox level check port 64, for example, or other portion of machine 20, to check a level of oil in a gearbox 58 of rotor drive train 200 and, if necessary, add oil to bring the oil levels to the proper level. In some exemplary embodiments, machine control system 150 may be part of an overall machine autonomous control system, in which instructions from an off-board control system may be transmitted to machine 20, allowing machine 20 to perform operations based on predetermined requirements (e.g. predetermined relative positions of various machine components) and/or inputs received based on measurements from various sensors associated with machine 20.

Machine control system 150 may include, for example, one or more controllers 152, input devices 158, display devices 160, height sensors 40, position sensors 120, angle sensors 140, drum position sensors 162, ground speed sensors 164, drum speed sensors 166, and/or any other types of sensors that may measure one of more physical or operational characteristics associated with machine 20. For example, control system 150 may include torque sensors, power sensors, etc. to determine an amount of power being delivered by the engine during operations of machine 20. Determination of operational characteristics of the machine may provide information useful in determining whether certain maintenance or repair procedures may need to be performed immediately or in the near future. Additionally control system 150 may include one or more of temperature sensors, pressure sensors, flow-rate sensors, etc. One purpose of accumulating information from the various sensors may include determining present operational characteristics of machine 20, to ensure that the machine is stopped and in a safe and non-operational state before various components are moved automatically by control system 150 into proper positions for enabling maintenance or repair operations. The maintenance or repair operations may include checking oil levels, replacing or adding oil, replacing or repairing worn components, and other maintenance and repair operations that are facilitated by moving various portions of machine 20 into particular, predetermined positions, and locking the machine into those positions for safety reasons during the maintenance or repair operations.

Controller 152 may include one or more processors 154, memory devices 156, and/or communications interfaces 168. Controller 152 may be configured to control operations of one or more of input devices 158, display devices 160, actuators 42, and/or other components or operations of machine 20. Processor 154 may embody a single or multiple microprocessors, digital signal processors (DSPs), application-specific integrated circuit devices (ASICs), etc. Numerous commercially available microprocessors can be configured to perform the functions of processor 154. Various other known circuits may be associated with processor 154, including power supply circuitry, signal-conditioning circuitry, and communication circuitry.

The one or more memory devices 156 may store, for example, one or more control routines, instructions, and/or data for determining a position of various portions and components of machine 20 relative to each other and/or to ground surface 22, and for controlling one or more other machine characteristics of machine 20, such as commanding power from the machine's power source to be applied to one or more extenders in order to level machine 20 even when machine 20 is not located on level ground. Angle sensors 140 may be positioned on the frame or other portions of the machine and provide input to the one or more control routines for determining adjustments that may be needed in order to level machine 20 is desired, such as when checking oil levels or performing other service or maintenance procedures. In some alternative implementations, control instructions may also include commands for rotation and steering of traction devices 32 to maneuver machine 20 into a completely level position on a level area of ground surface 22. Memory device 156 may embody non-transitory computer-readable media, for example, Random Access Memory (RAM) devices, NOR or NAND flash memory devices, and Read Only Memory (ROM) devices, CD-ROMs, hard disks, floppy drives, optical media, solid state storage media, etc. Controller 152 may receive one or more input signals from the one or more input devices 158 and may execute the routines or instructions stored in the one or more memory devices 156 to generate and deliver one or more command signals to one or more of actuators 42, and/or other components of machine 20. In one exemplary embodiment, an operator may simply press one icon on a touch-sensitive display interface, press one button, or otherwise perform a simple input operation or series of input operations from within the operator cabin or operator platform of machine 20 to initiate a sequence of operations that include moving machine 20 into a level position, and then raising or lowering drum chamber 36, rotor drive train 200, milling drum 38, and/or other components of machine 20 relative to each other and relative to ground surface 22 to position machine 20 into a predetermined machine service set position. The machine service set position may be characterized by a set of data, measurements, geographical coordinates, and machine operational characteristics stored in memory device 156 for a particular type, make, and model of machine 20 such that a technician can access the areas and components necessary to perform particular maintenance or repair procedures.

In some exemplary embodiments, a communications interface 168 may allow software and/or data to be transferred between an off-board autonomous vehicle control system and controller 152. Examples of communications interface 168 may include a network interface (e.g., a wireless network card), a communications port, a PCMCIA slot and card, a cellular network card, a global positioning system (GPS) transceiver, etc. Communications interface 168 may transfer software and/or data in the form of signals, which may be electronic, electromagnetic, optical, or other signals capable of being transmitted and received by communications interface 168. Communications interface 168 may transmit or receive these signals using a radio frequency ("RF") link, Bluetooth link, satellite links, and/or other wireless communications channels. It is contemplated that in some exemplary embodiments, data or instructions may be received via communications interface 168 and may be stored in memory device 156. One or more control signals for controlling the positions of the various portions and components of machine 20 may be received by controller 152 from an off-board controller via communications interface 168.

One or more input devices 158 may be located in operator cabin 26 or on an operator platform. Input devices 158 may include one or more of a button, lever, joystick, key, knob, pedal, display icon on a touch screen, or other input device known in the art. An operator of machine 20 may use one or more input devices 158 to provide one or more inputs, which may be received by controller 152. For example, the one or more input device 158 may be configured to receive a command from an operator to move machine 20 into a desired machine service set position. In some exemplary implementations, the operator may also provide input regarding what type of service or maintenance needs to be performed. In this situation, machine control system 150 may retrieve a unique set of command instructions from memory for the best machine service set position corresponding to the type of service or maintenance that needs to be performed, as a function of the particular type, make, and model of machine 20, and taking into consideration the present operational characteristics, geographical coordinates, and other factors relevant to the type of service or maintenance to be performed. Input devices 158 may also be used to operate machine 20 and may also be used to manually control actuators 42 and other components of machine 20. Further, input devices 158 may be used to control height of individual legs of the machine in order to level the entire machine relative to ground surface 22. In some alternative implementations, although not typically necessary for leveling machine 20, input devices 158 may control a ground speed of machine 20 and/or to steer machine 20 in order to move the entire machine to a level position on level ground surface 22. Alternatively, one simple input by an operator may initiate all of the actions and controls necessary to move machine 20 and/or components and portions of machine 20 into a predetermined, desired machine service set position.

One or more display devices 160 may be associated with controller 152 and may be configured to display data or information in cooperation with processor 154. Display device 160 may be a cathode ray tube (CRT) monitor, a liquid crystal display (LCD), a light emitting diode (LED) display, a touchscreen display, or any other kind of display device known in the art.

Drum position sensor 162 may be associated with one or more of actuators 42. Drum position sensor 162 may be configured to generate a signal indicative of a position of milling drum 38 relative to frame 24. In one exemplary embodiment, drum position sensor 162 may be configured to generate a signal indicative of a height of a bottommost portion (e.g. tip of the lowest tooth 48) of milling drum 38 relative to frame 24. Drum position sensor 162 may include one or more types of position sensors similar to those discussed above for position sensor 120.

Ground speed sensor 164 may be associated with one or more of traction devices 32, and may be configured to measure a speed (e.g. feet per second, miles per hour, etc.) at which traction devices 32 or machine 20 may be propelled over ground surface 22. Ground speed sensor 164 may be configured to generate one or more signals indicative of a ground speed of one or more of traction devices 32, and may send the one or more signals to controller 152. Controller 152 may additionally or alternatively determine a ground speed of machine 20 in other ways, for example, using GPS sensors, inertial sensors, flow rate or pressure of hydraulic fluid in hydraulic motors associated with traction devices 32, etc. A determination of ground speed of machine 20 and/or other operational characteristics of machine 20 may be performed by machine control system 150 prior to initiating any actions to move machine 20 into a machine service set position, and locking machine 20 into the desired machine service set position before issuing an all-clear signal to a technician for performing maintenance or service procedures.

Drum speed sensor 166 may be associated with milling drum 38 and may be configured to measure a rotational speed of milling drum 38 (e.g. rpm or revolutions per minute). Drum speed sensor 166 may be configured to generate and send one or more signals indicative of the rotational speed of milling drum 38 to controller 152. Controller 152 may additionally or alternatively determine the rotational speed of the milling drum based on other parameters such as rotational speed of the engine, transmission or gear ratio, etc.

Controller 152 (or processor 154) may be configured to determine a position of one or more machine portions or components based on input parameters specified by an operator of machine 20 and one or more machine characteristics associated with machine 20. For example, input parameters specified by an operator may include a predetermined position of drum chamber 36, milling drum 38, rotor drive train 200, predetermined ground speed, machine position, operational characteristics, etc. Machine characteristics associated with machine 20 may include, for example, height of frame 24 relative to ground surface 22, a position of milling drum 38 (e.g. height of milling drum 38 relative to frame 24), height of drum chamber 36 relative to ground surface 22, ground speed of machine 20, rotational speed of milling drum 38, an engine characteristic of an engine operating machine 20, battery characteristics of a battery providing power to operate machine 20, etc. Engine characteristics of an engine may include, for example, engine speed, engine torque, rate of fuel consumption, amount of power generated by the engine, fuel efficiency, etc. The above-described list of machine and/or engine characteristics is not limiting and additional machine and/or engine characteristics may be employed.

In some exemplary implementations, machine 20 may include a reader configured to read a key fob, card, etc. associated with an operator. Controller 152 may receive the information stored in the key fob, card, etc. and determine an identifier associated with the operator of the machine based on that information. In other exemplary embodiments, an operator may enter identifying information using the one or more input devices 158. Controller 152 may be configured to retrieve stored machine characteristics associated with the identifying information for the operator, and/or with the particular type, make, and model of machine 20. Controller 152 may use the retrieved machine characteristics and/or thresholds to determine the desired positions of the various portions and components of machine 20 when machine 20 is in a desired machine service set position. The saved machine characteristics may help ensure that the machine may be quickly set up for a particular type of service or maintenance. Controller 152 may also be configured to save machine characteristics and/or thresholds specified by an operator in memory device 156 and/or transmit the saved machine characteristics to an offboard control system via communications interface 168.

INDUSTRIAL APPLICABILITY

The control system of the present disclosure may be used to automatically adjust the positions of various portions or components of a machine such as a reclaimer or cold planer, and lock the portions or components into one or more final, predetermined machine service set positions that present a technician with desired access to various portions or components of the machine and facilitate the performance of maintenance or repair procedures. By doing so, the control system of the present disclosure may eliminate the need for an operator to attempt to manually operate controls from within the cab or on an operator platform of the machine in order to move portions or components of the machine, without having a good vantage point for determining that the portions or components of the machine have been moved to the desired positions for performing the maintenance or repair procedures. For example, inspection of an oil level within a rotor drivetrain gearbox on a reclaimer, rotary mixer, or cold planer may require raising or lowering the level of drum chamber 36, moving rotor drive trains 200, and raising or lower the level of milling drum 38, shown in FIG. 1, after having leveled machine 20 through the use of adjustable legs, or after having moved machine 20 to a level ground surface 22, to move portions and components of machine 20 into a predetermined machine service set position at which the technician can easily access and observe a gearbox oil level check port 64 to check a level of oil in a gearbox 58 of rotor drive train 200 and, if necessary, add oil to bring the oil levels to the proper level. The same principles and sequences of actions and operations performed by control system 150 according to various embodiments of this disclosure may be employed in programming processor 154 to be a special purpose processor configured to implement control commands and actions to automatically move machine 20, portions of machine 20, and components of machine 20 as required to position machine 20 into a machine service set position appropriate for performing other service, maintenance, and repair procedures, such as replacing worn components or repairing damaged components on machine 20.

A method performed by the control system 150 and special purpose processor 154 of controller 152 according to various embodiments of this disclosure may include receiving one or more input parameters. The input parameters may include, for example, the type, make, and model of the machine, the type of service, repair, or maintenance procedures that need to be performed on the machine, and machine physical and operational characteristics that may be relevant before, during, or after the performance of the service, repair, or maintenance procedures on the particular machine. The one or more input parameters may be received by control system 150 from an operator of machine 20, for example, via the one or more input devices 158 associated with machine 20, or may be retrieved from memory device 156 by special purpose processor 154 of controller 152 in control system 150.

In one exemplary embodiment, controller 152 may determine the positions and orientations of various portions or components of machine 20 using input from sensors such as height sensor 40, position sensors 120, 140, drum position sensor 162, ground speed sensor 164, and drum speed sensor 166, along with one or more of look-up tables, flow charts, physical models, machine learning models, simulations, or other algorithms stored in memory device 156 or received by controller 152 over communications interface 168. For example, memory device 156 may store one or more look-up tables correlating dimensions of machine 20 and various components of machine 20, and relative positions and orientations of the various components depending on present operational parameters and use of machine 20. Controller 152 may employ one or more of these look-up tables stored in memory device 156 to determine the relative positions and orientations of the various components of machine 20 and the best or preferred sequence of operations to move the various components from where they are currently to where they need to be in a machine service set position for performing maintenance, repair, or service procedures. In other exemplary embodiments, memory device 156 may store one or more mathematical or numerical correlations, or algorithms that may correlate relative positions of the various components of machine 20 with one or more parameters such as the height of frame 24, the height of drum chamber 36 off of ground surface 22, the position of milling drum 38, ground speed, engine speed, engine torque, power delivered by the engine or other power source, fuel consumption, etc. Controller 152 and special purpose processor 154 may implement the one or more mathematical or numerical correlations or algorithms to determine the relative positions and orientations of the various portions of machine 20 and of various machine components based on the machine characteristics selected by the operator. Alternatively, in some exemplary embodiments, controller 152 may execute one or more virtual machine learning models stored in memory device 156, and perform machine learning using the models, stored training data, and training parameters to determine the relative positions and orientations of the various machine components, and the most efficient sequence of operations for moving the various machine components into the desired machine service set position. The sequence of operations may include commanding various movements of machine 20 to bring machine 20 into a level position on a level area of ground surface 22 before other machine components are moved into the machine service set position. One or more machine learning models may be updated by receiving updated models from an offboard control system via communications interface 168 and storing the updated models in memory device 156.

A method performed by control system 150 according to various embodiments of this disclosure may include determining whether any of the positions of various portions of a presently operational machine or machine components on the presently operational machine, and/or any of the machine present operational characteristics determined by machine controller 152 are different from the same machine-related characteristics at a prior time when the machine was in a machine service set position and particular maintenance or repair procedures were performed. When controller 152 determines that one or more of the positions of machine components, and/or any of the machine characteristics have changed by more than predetermined thresholds, controller 152 may determine that a machine service set position cannot be achieved at the present time, or other procedures must be followed before putting the machine into a desired machine service set position.

It will be apparent to those skilled in the art that various modifications and variations can be made to the disclosed machine control system for enabling automatic movement of machine 20 into a desired machine service set position. Other embodiments will be apparent to those skilled in the art from consideration of the specification and practice of the disclosed systems and methods. It is intended that the specification and examples be considered as exemplary only, with a true scope being indicated by the following claims and their equivalents.

What is claimed is:

1. A machine service set position control system, wherein the control system is used on a machine that includes a frame, a plurality of traction devices connected to the frame, a power source connected to the plurality of traction devices and configured to rotate the traction devices, a drum chamber connected to the frame, a milling drum rotatably supported within the drum chamber and configured to engage with a ground surface, a rotor drive train connected to the milling drum and configured to rotate the milling drum to mill the ground surface, the rotor drive train including a gearbox, and at least one sensor configured to generate signals representing one or more of an amount of extension or retraction of an actuator, amount of rotation of a pivotal structure, proximity to a surface, and geographical position in space, the service set position control system comprising:

one or more memory devices storing program instructions; and one or more processors programmed to execute the program instructions to perform operations comprising:

determining a position of at least the rotor drive train with the gearbox using the at least one sensor;

determining whether the machine is level before determining the position of at least the rotor drive train;

selectively operating a rotor drive train actuator connected to the rotor drive train based on the determined position to move the rotor drive train and gearbox into a machine service set position allowing access for a technician to perform service tasks including one or more of inspecting an oil level in the rotor drive train gearbox and adding oil if required;

operating the power source and a plurality of adjustable height legs to level the machine when the control system determines that the machine is not level prior to performing the service tasks;

determining a height of the frame relative to the ground surface;

determining a position of the rotor drive train relative to the machine frame;

determining a height of the drum chamber; and determining a height of the milling drum relative to the ground surface.

2. The machine service set position control system of claim 1, wherein the one or more processors of the service set position control system are further programmed to execute the program instructions to perform operations comprising operating one or more machine height adjustment actuators to raise the frame of the machine, and operating the rotor drive train actuator to lower the milling drum in the process of moving the rotor drive train and the rotor gearbox into the machine service set position.

3. The machine service set position control system of claim 1, comprising:

one or more input devices;

one or more display devices;

one or more height sensors;

one or more position sensors; and one or more sensors configured to measure one of more physical or operational characteristics associated with the machine.

4. The machine service set position control system of claim 3, wherein:

one or more of the one or more memory devices include one or more stored control routines, stored instructions, and stored data for determining a position of various portions and components of the machine relative to each other and to the ground surface, and for controlling one or more machine characteristics of the machine, including commanding the application of power from the machine's power source for adjusting the height of the frame to position the frame level relative to the ground surface.

5. The machine service set position control system of claim 4, wherein:

the one or more processors are programmed for receiving one or more input signals from the one or more input devices, and executing the stored control routines or stored instructions retrieved from the one or more memory devices to generate and deliver one or more command signals to one or more actuators of the machine.

6. The machine service set position control system of claim 3, wherein:

the one or more processors are programmed for receiving an input from the technician performing an input operation to initiate a sequence of operations that include moving the machine into a level position, and then raising or lowering the drum chamber, rotor drive train, milling drum, and/or other portions or components of the machine relative to each other and relative to the ground surface to position the machine into the machine service set position.

7. The machine service set position control system of claim 6, wherein the one or more memory devices store data, measurements, geographical coordinates, and machine operational characteristics for a particular type, make, and model of the machine that enable the technician to access the portions and components of the machine that facilitate performance of the service tasks.

8. A machine, comprising:

a frame supported by a plurality of wheels;

a power source connected to the plurality of wheels and configured to rotate the wheels;

a milling drum attached to the frame through a rotor drive train, the rotor drive train including a gearbox, the rotor drive train being configured to rotate the milling drum and move the milling drum into and out of engagement with a ground surface; and a machine service set position control system programmed to:

determine a position of the machine and a position of at least the rotor drive train and milling drum, determine whether the machine is level before determining the position of at least the rotor drive train and milling drum, issue commands to level the machine relative to the ground surface, selectively operate a rotor drive train actuator connected to the rotor drive train based on the determined positions to move the rotor drive train and rotor gearbox into a machine service set position allowing access for a technician to perform service tasks including one or more of inspecting an oil level in the rotor drive train gearbox and adding oil if required, operate the power source to adjust a height of the frame to position the frame level relative to the ground surface prior to performing the service tasks, determine a height of the frame relative to the ground surface, determine a height of the drum chamber, and determine a height of the milling drum relative to the ground surface.

9. The machine of claim 8, wherein the service set position control system is further programmed to operate one or more machine height adjustment actuators to raise the frame of the machine, and operate the rotor drive train actuator to lower the milling drum in the process of moving the rotor drive train and the rotor drive train gearbox into the machine service set position.

10. The machine of claim 9, further including at least one sensor that comprises one or more of a sonic sensor, a LIDAR sensor, a RADAR sensor, a laser sensor, a contact sensor, and a global positioning system sensor, configured to generate signals representing one or more of an amount of extension or retraction of an actuator, amount of rotation of a pivotal structure, proximity to a surface, and geographical position in space.

11. The machine of claim 8, wherein the machine service set position control system comprises:

one or more controllers;

one or more memory devices;

one or more input devices;

one or more display devices;

one or more height sensors;

one or more position sensors; and one or more sensors configured to measure one of more physical or operational characteristics associated with the machine.

12. The machine of claim 11, wherein:

one or more of the one or more memory devices of the machine service set position control system include one or more stored control routines, stored instructions, and stored data for determining a position of various portions and components of the machine relative to each other and to the ground surface, and for controlling one or more machine characteristics of the machine, including commanding the application of power from the machine's power source for frame height adjustment to maneuver the machine into a level position relative to the ground surface.

13. The machine of claim 12, wherein:

the one or more controllers are programmed for receiving one or more input signals from the one or more input devices, and executing the stored control routines or stored instructions retrieved from the one or more memory devices to generate and deliver one or more command signals to one or more actuators of the machine.

14. The machine of claim 12, wherein:

the one or more controllers are programmed for receiving an input from the technician performing an input operation to initiate a sequence of operations that include moving the machine into a level position, and then raising or lowering the drum chamber, rotor drive train, milling drum, and/or other portions or components of the machine relative to each other and relative to the ground surface to position the machine into the machine service set position.

15. The machine of claim 14, wherein:

the one or more memory devices store data, measurements, geographical coordinates, and machine operational characteristics for a particular type, make, and model of the machine that enable the technician to access the portions and components of the machine that facilitate performance of the service tasks.

* * * * *